US012742229B1

(12) United States Patent
Anwar et al.

(10) Patent No.: US 12,742,229 B1
(45) Date of Patent: Sep. 22, 2026

(54) HIGH DENSITY LOW VISCOSITY LIQUID METAL AND METHODS THEREOF

(71) Applicant: UNM RAINFOREST INNOVATIONS, Albuquerque, NM (US)

(72) Inventors: Ishtiaque Anwar, Albuquerque, NM (US); John Stormont, Albuquerque, NM (US); Mahya Hatambeigi, Albuquerque, NM (US)

( * ) Notice: Subject to any disclaimer, the term of this patent is extended or adjusted under 35 U.S.C. 154(b) by 977 days.

(21) Appl. No.: 17/692,364

(22) Filed: Mar. 11, 2022

Related U.S. Application Data

(60) Provisional application No. 63/159,606, filed on Mar. 11, 2021.

(51) Int. Cl.
*C22C 28/00* (2006.01)
*C22C 1/02* (2006.01)

(52) U.S. Cl.
CPC ..... *C22C 28/00* (2013.01); *C22C 1/02* (2013.01)

(58) Field of Classification Search
CPC ..... C22C 28/00; C22C 1/02
See application file for complete search history.

(56) References Cited

U.S. PATENT DOCUMENTS 5,792,236 A * 8/1998 Taylor ..... C22C 28/00 423/115

FOREIGN PATENT DOCUMENTS

CN 104593656 A * 5/2015
CN 107513654 A * 12/2017 ..... C22C 30/04
CN 105970058 B * 4/2018

OTHER PUBLICATIONS

CN-105970058-B, machine translation. (Year: 2018).*
CN-104593656-A, machine translation. (Year: 2015).*
CN-107513654-A, machine translation. (Year: 2017).*
Bernhoft, Robin A. "Mercury toxicity and treatment: a review of the literature." Journal of environmental and public health 2012 (2012).
Dickey, Michael D. et al. "Eutectic gallium-indium (EGaIn): a liquid metal alloy for the formation of stable structures in microchannels at room temperature." Advanced functional materials 18.7 (2008): 1097-1104.
Gidlow, D. A. "Lead toxicity." Occupational medicine 54.2 (2004): 76-81.
Giesche, Herbert. "Mercury porosimetry: a general (practical) overview." Particle & particle systems characterization 23.1 (2006): 9-19.

(Continued)

*Primary Examiner* — John A Hevey
(74) *Attorney, Agent, or Firm* — MH2 Technology Law Group LLP

(57) ABSTRACT

A metal alloy is disclosed, includes gallium, indium, bismuth, and tin, is a liquid at a temperature of about 24° C., and is a solid below a temperature of about 16°C. The gallium is present in an amount of from about 60 wt % to about 70 wt % based on a total weight of the metal alloy. The indium is present in an amount of from about 20 wt % to about 30 wt % based on a total weight of the metal alloy. The bismuth is present in an amount of from about 0.5 wt % to about 15 wt % based on a total weight of the metal alloy. The tin is present in an amount of from about 0.5 wt % to about 20 wt % based on a total weight of the metal alloy. A method of preparing the liquid metal alloy is also disclosed.

6 Claims, 4 Drawing Sheets

(56) References Cited

OTHER PUBLICATIONS

Krohn, V. E. "Liquid metal droplets for heavy particle propulsion." Electrostatic propulsion (1961): 73-80.
Lipchitz, A. et al. "Suitability of eutectic field's metal for use in an electromagnetohydrodynamically-enhanced experimental two-phase flow loop." International Conference on Nuclear Engineering. vol. 44991. American Society of Mechanical Engineers, 2012.
Lockitch, Gillian. "Perspectives on lead toxicity." Clinical biochemistry 26.5 (1993): 371-381.
Moulis, Jean-Marc et al. "New perspectives in cadmium toxicity: an introduction." Biometals 23 (2010): 763-768.
Siegel Adam C. et al. "Cofabrication of electromagnets and microfluidic systems in poly (dimethylsiloxane)." Angewandte Chemie 118.41 (2006): 7031-7036.

* cited by examiner

HIGH DENSITY LOW VISCOSITY LIQUID METAL AND METHODS THEREOF

CROSS-REFERENCE TO RELATED APPLICATIONS

This application claims priority to U.S. Provisional Patent Application Ser. No. 63/159,606, filed Mar. 11, 2021, the disclosure of which is incorporated herein by reference.

FIELD

This invention relates generally to metal alloy compositions, and specifically liquid metal alloy compositions having high density and low viscosity at room temperature.

BACKGROUND

Metal alloys that are liquid at or near room temperature have been the subject of many research interests due to their advantageous rheological characteristics, for example, they can flow easily in response to any applied stress. One known liquid metal is mercury (Hg). However, the toxicity of mercury, alloys thereof, and other liquid metals limits their application in many areas. These other commercially available liquid metal alloys pose health risks as well among other issues. Available liquid metals may need to be melted at higher temperatures prior to use, may react in the presence of oxygen or air, have scarce availability, or are prohibitively expensive.

Thus, there is a need for alternative liquid metals having similar properties as currently available materials, without the associated disadvantages, such as toxicity, availability, expense, and

SUMMARY

The following presents a simplified summary in order to provide a basic understanding of some aspects of one or more embodiments of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later.

A metal alloy is disclosed. The metal alloy includes gallium, indium, bismuth, and tin. Implementations of the metal alloy include where the metal alloy is a liquid at a temperature of about 24° C. The metal alloy is a solid below a temperature of about 16° C. The gallium is present in an amount of from about 60 wt % to about 70 wt % based on a total weight of the metal alloy. The indium is present in an amount of from about 20 wt % to about 30 wt % based on a total weight of the metal alloy. The bismuth is present in an amount of from about 0.5 wt % to about 15 wt % based on a total weight of the metal alloy. The tin is present in an amount of from about 0.5 wt % to about 20 wt % based on a total weight of the metal alloy. The metal alloy has a contact angle greater than 90 degrees at a temperature of about 24° C. The metal alloy has a viscosity of about 1.5×10-3 Pa·s at a temperature of about 24° C. The metal alloy has a resistivity of about 15×10-6 ohm-cm. The metal alloy has a density of about 8.3 g/cm$^3$. The metal alloy includes no mercury, cadmium, or lead.

A method of preparing a metal alloy is disclosed. The method of preparing a metal alloy includes introducing gallium, indium, bismuth, and tin into a pressurized chamber, introducing an inert gas into the pressurized chamber, and raising the pressurized chamber to an elevated temperature to melt and combine the gallium, indium, bismuth, and tin to form the metal alloy. Implementations of the method of preparing a metal alloy may include where the inert gas is nitrogen. In the method of preparing a metal alloy, the gallium is present in an amount of from about 60 wt % to about 70 wt % based on a total weight of the metal alloy, the indium is present in an amount of from about 20 wt % to about 30 wt % based on a total weight of the metal alloy, the bismuth is present in an amount of from about 0.5 wt % to about 15 wt % based on a total weight of the metal alloy, and the tin is present in an amount of from about 0.5 wt % to about 20 wt % based on a total weight of the metal alloy.

A porosimetry method is disclosed. The porosimetry method includes melting a metal alloy including gallium, indium, bismuth, and tin to form a liquid metal alloy, introducing the liquid metal alloy into a test material, and observing the metal alloy entrained within the test material. An investment casting method is disclosed, including melting a metal alloy including gallium, indium, bismuth, and tin to form a liquid metal alloy, introducing the liquid metal alloy into a mold, and allowing the liquid metal alloy to cool to form a solid to produce a pattern from the mold.

Advantages of the embodiments will be set forth in part in the description which follows, and in part will be understood from the description, or may be learned by practice of the invention. The advantages will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE FIGURES

The accompanying drawings, which are incorporated in and constitute a part of this specification, illustrate embodiments of the present teachings. These and/or other aspects and advantages in the embodiments of the disclosure will become apparent and more readily appreciated from the following description of the various embodiments, taken in conjunction with the accompanying drawings of which.

Figure 1:
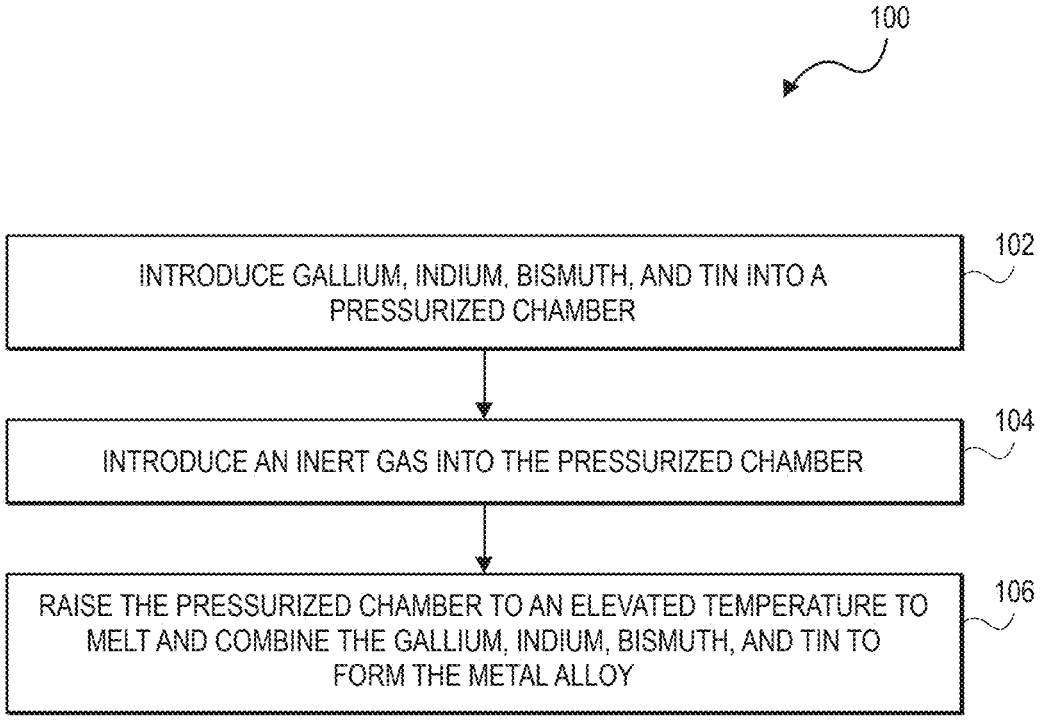
FIG. 1 depicts a flowchart of a method for preparing a liquid metal alloy, in accordance with the present disclosure.

It should be noted that some details of the figures have been simplified and are drawn to facilitate understanding of the present teachings rather than to maintain strict structural accuracy, detail, and scale.

DETAILED DESCRIPTION

The following description of various typical aspect(s) is merely exemplary in nature and is in no way intended to limit the disclosure, its application, or uses.

As used throughout, ranges are used as shorthand for describing each and every value that is within the range. Any value within the range may be selected as the terminus of the range. In addition, all references cited herein are hereby incorporated by reference in their entireties. In the event of a conflict in a definition in the present disclosure and that of a cited reference, the present disclosure controls.

Unless otherwise specified, all percentages and amounts expressed herein and elsewhere in the specification should be understood to refer to percentages by weight. The amounts given are based on the active weight of the material.

Additionally, all numerical values are "about" or "approximately" the indicated value, and take into account experimental error and variations that would be expected by a person having ordinary skill in the art. It should be appreciated that all numerical values and ranges disclosed herein are approximate values and ranges, whether "about" is used in conjunction therewith. It should also be appreciated that the term "about," as used herein, in conjunction with a numeral refers to a value that may be ±0.01% (inclusive), ±0.1% (inclusive), ±0.5% (inclusive), ±1% (inclusive) of that numeral, ±2% (inclusive) of that numeral, ±3% (inclusive) of that numeral, ±5% (inclusive) of that numeral, ±10% (inclusive) of that numeral, or ±15% (inclusive) of that numeral. It should further be appreciated that when a numerical range is disclosed herein, any numerical value falling within the range is also specifically disclosed.

As used herein, the term "or" is an inclusive operator, and is equivalent to the term "and/or," unless the context clearly dictates otherwise. The term "based on" is not exclusive and allows for being based on additional factors not described, unless the context clearly dictates otherwise. In the specification, the recitation of "at least one of A, B, and C," includes examples containing A, B, or C, multiple examples of A, B, or C, or combinations of A/B, A/C, B/C, A/B/B/B/B/C, A/B/C, etc. In addition, throughout the specification, the meaning of "a," "an," and "the" include plural references. The meaning of "in" includes "in" and "on."

Reference will now be made in detail to exemplary examples of the present teachings, examples of which are illustrated in the accompanying drawings. Wherever possible, the same reference numbers will be used throughout the drawings to refer to the same, similar, or like parts.

While liquid metals, for example, mercury (Hg) and alloys thereof, particularly those including cadmium (Cd) or lead (Pb), are known in the art and used in various measurement devices, electrical devices, and medical applications. The toxicity of mercury, alloys thereof, and other liquid metals limits their application as these commercially available liquid metal alloys pose health risks, reactivity to environmental conditions, and high costs.

The present disclosure provides a non-toxic gallium-based liquid metal and a method for making such liquid metals useful in a range of applications, from electronics to the medical industry. A metal alloy, including gallium, indium, bismuth, and tin that is liquid at a temperature of about 24° C., or approximately room temperature, is provided. In certain examples, the metal alloy is a solid below a temperature of about 16° C.

Metal alloys of the present disclosure can be composed of gallium, indium, bismuth, and tin, is liquid at room temperature of about 24° C. (75.2° F.) and turns to solid at a temperature below 16.2° C. (61.2° F.). In certain examples of the present disclosure, gallium (Ga) is present in the liquid metal alloy in an amount of from about 50 wt % to about 80 wt %, or from about 60 wt % to about 70 wt % based on a total weight of the metal alloy. In some examples of the present disclosure, indium (In) is present in the liquid metal alloy in an amount of from about 10 wt % to about 40 wt %, or from about 20 wt % to about 30 wt % based on a total weight of the metal alloy. In certain examples of the present disclosure, bismuth (Bi) is present in the liquid metal alloy in an amount of from about 0.1 wt % to about 25 wt %, or from about 0.5 wt % to about 15 wt % based on a total weight of the metal alloy. In still other examples of the present disclosure, tin (Sn) is present in the liquid metal alloy in an amount of from about 0.1 wt % to about 30 wt %, or from about 0.5 wt % to about 20 wt % based on a total weight of the metal alloy. It should be noted that the liquid metal alloy includes no mercury, cadmium, or lead. Furthermore, liquid metal alloys of the present disclosure undergo negligible or no oxidation when exposed to air, oxygen, and other oxidizing environmental conditions. While not wishing to be bound by any particular theory, it is thought that the presence of bismuth provides the prevention of oxidation of the compositions of the liquid metal alloy.

An exemplary example of a liquid metal alloy provided by the present disclosure includes a metal alloy having a composition of 66.5 wt % Ga, 24.5 wt % In, 2.5 wt % Bi, and 6.5 wt % Sn. Liquid metal alloys as disclosed herein can be prepared in a pressurized chamber filled with nitrogen gas at an elevated temperature. The method of preparing the liquid metal alloy includes introducing gallium, indium, bismuth, and tin into a pressurized chamber, introducing an inert gas into the pressurized chamber, and raising the pressurized chamber to an elevated temperature to melt and combine the gallium, indium, bismuth, and tin to form the metal alloy. The preparation technique, as well as the variation of the elemental composition, affects the melting point and the wettability of the novel metal alloy.

Liquid metal alloys in accordance with the present disclosure can have a contact angle greater than 90 degrees at room temperature, or a temperature of about 24° C., ranging from about 90 degrees to about 110 degrees. Liquid metal alloys in accordance with the present disclosure can have a viscosity of about $1.5\times10^{-3}$ Pa·s at room temperature, or a temperature of about 24° C., with a range of from about $10^{-3}$ Pa·s to about $10^{-2}$ Pa·s. Liquid metal alloys in accordance with the present disclosure can have a resistivity of about $15\times10^{-6}$ ohm-cm, ranging from about $10^{-6}$ ohm-cm to about $10^{-5}$ ohm-cm. Liquid metal alloys in accordance with the present disclosure can further have a density of about 8.3 g/cm$^3$, ranging from about 7.0 g/cm$^3$ to about 8.5 g/cm$^3$. Additional properties associated with liquid metal alloys of the present disclosure include an increase in hardness and other physical properties of the liquid metal alloy as the temperature of the liquid metal alloy decreases, and the metal alloy solidifies. Without being bound by a particular theory, it is considered that while the constituent metals in liquid metal alloys of the present disclosure are separate, the individual metals behave as their respective solid metals. By contrast, when combined in metal alloys as described herein, the metals behave differently based on a consideration that the rearrangement and interaction of the individual crystalline structure of the metals provides the related properties.

Liquid metal alloys in accordance with the present disclosure have several advantages as compared to currently available liquid metal alloys present in the market, which suffer from the disadvantage that they contain metals that are mostly considered toxic, such as, but not limited to, mercury, cadmium, lead. As individually, the elemental composition of the liquid metal alloy compositions is considered to be individually non-toxic, alloys made from the constituent elemental metals as disclosed herein, are also relatively safe to use. Liquid metal alloys according to the present disclosure further have a negligible vapor pressure at room temperature compared to other available liquid metals. As such, there exists limited concern related to inhalation when working with the liquid metal alloys of the present disclosure.

As compared to certain eutectic fusible alloys such as Wood's metal and Field's metal that require a higher temperature to be in a liquid state, the metal alloy of the present disclosure is liquid at room temperature. Wood's metal alloy is composed of 50% bismuth, 26.7% lead, 13.3% tin, and 10% cadmium by mass. Field's metal alloy is composed of 32.5% bismuth, 51% indium, and 16.5% tin. Liquid metals of the present disclosure can easily flow through the restricted structures, such as microchannels, which may be of interest in a variety of research and industrial applications. Due to the rheological characteristics of the liquid metal alloys, it can be useful for numerous additional applications.

In certain examples, the percentage of gallium is relatively lower liquid metal alloy as compared to presently available gallium-indium alloys in the market such as eutectic gallium-indium alloy, or EGaIn. Hence, the liquid metal alloy of the present disclosure, with the addition of bismuth and tin will provide relatively a reduced level of gallium oxide as compared to available gallium-indium alloy, with the improved rheological characteristics of lower viscosity and higher penetrability, almost equivalent to nonwetting fluids, including, but not limited to nitrogen gas. The electrical conductivity of the alloy is also higher than available gallium-based alloys and is therefore better suited for application to electronic components. Liquid metal alloys according to the present disclosure provide a non-wetting, contact angle >90°, fluid at room temperature, or at about 24° C. The contact angle of the liquid metal alloy in contact with solids can be between from about 130° to about 140°. The surface tension of the liquid can depend on the temperature, presence of ambient oxygen, and the specific elemental composition of the alloy. In certain examples of the present disclosure, the viscosity of the liquid metal alloy is measured using a Brookfield RST-coaxial cylinder Rheometer. Device calibration is verified using a fluid of known viscosity. The viscosity of the test liquid metal alloy fluids can be measured multiple times before and after flow testing, or other methods, measurements, or evaluations. The viscosity of the metal alloy is approximately $1.55\times10^{-3}$ Pa·s, ranging from about $10^{-3}$ Pa·s to about $10^{-2}$ Pa·s. In certain examples of the present disclosure, the electrical resistivity can be measured using a two-electrode system with a simple laboratory setup. The resistivity of the liquid metal alloy as described herein is about $15.2\times10^{-6}$ Ω-cm.

FIG. 1 depicts a flowchart of a method for preparing a liquid metal alloy, in accordance with the present disclosure. A method of preparing a metal alloy 100 begins with a step to introduce gallium, indium, bismuth, and tin into a pressurized chamber 102, followed by a step to introduce an inert gas into the pressurized chamber 104, and finally a step to raise the pressurized chamber to an elevated temperature to melt and combine the gallium, indium, bismuth, and tin to form the metal alloy 106. In certain examples, the inert gas is nitrogen, while in alternative examples, inert gases used may be argon, helium, carbon dioxide ($CO_2$), or combinations thereof.

According to certain examples of the method of preparing a metal alloy 100, gallium is present in an amount of from about 60 wt % to about 70 wt % based on a total weight of the metal alloy. According to certain examples, indium is present in an amount of from about 20 wt % to about 30 wt % based on a total weight of the metal alloy. According to certain examples, bismuth is present in an amount of from about 0.5 wt % to about 15 wt % based on a total weight of the metal alloy. According to certain examples, tin is present in an amount of from about 0.5 wt % to about 20 wt % based on a total weight of the metal alloy. While these ranges stated are exemplary, the ranges of metal content based on weight percent of the total weight of the liquid metal alloy may vary in alternate examples.

Figure 2:
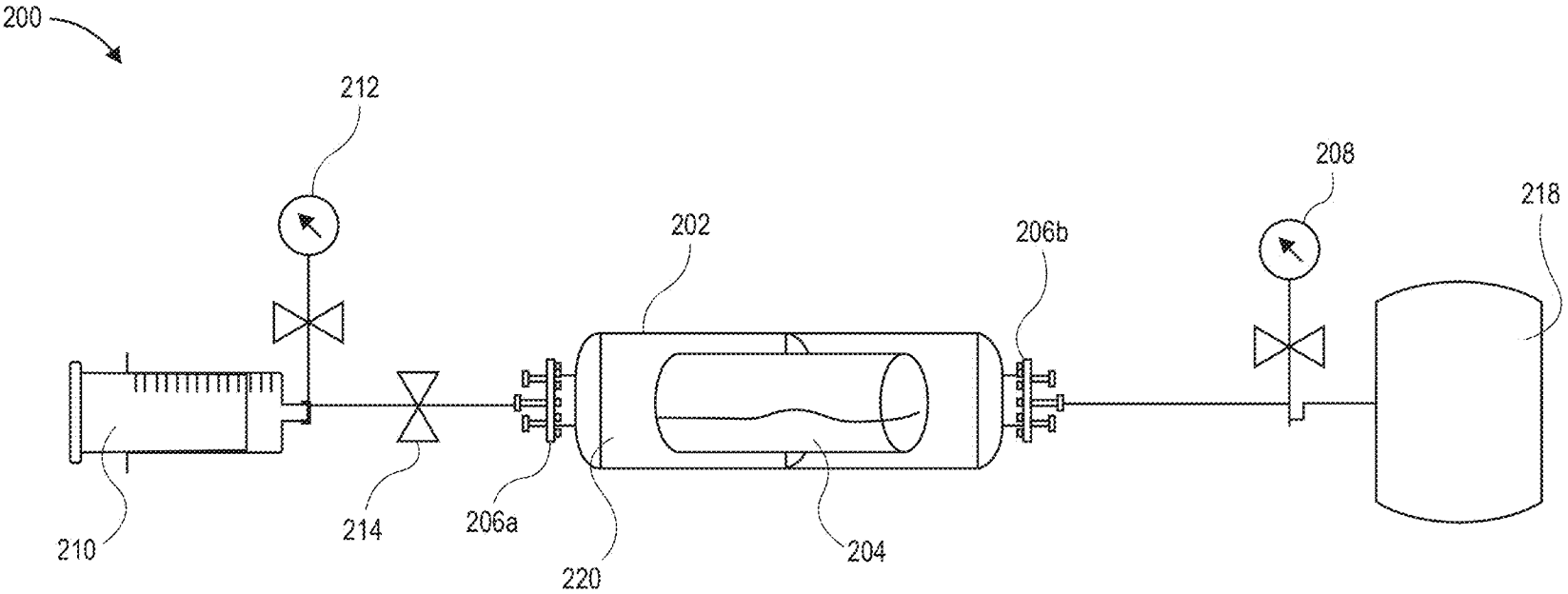
FIG. 2 is a schematic representation of a process for preparing a liquid metal alloy intrusion test configuration, in accordance with the present disclosure.

FIG. 2 is a schematic representation of a process for preparing a liquid metal alloy intrusion test configuration, in accordance with the present disclosure. As shown in FIG. 2, a study of the rheological characterization of the liquid metal alloy was conducted. In a certain example, it can be observed that the liquid metal alloy rapidly flows into and fills microchannels in a fracture at a critical pressure dependent upon the geometry of the channel or fracture within a geographical sample, and also maintains structural stability when this pressure is relieved. For example, the liquid metal alloy does not spontaneously retract from the fracture wall as the pressure is reduced.

The injection test is carried out at room temperature of 24° C. (75.2° F.), by placing a fractured cement sample 204 in a pressure vessel system 200. Equivalent axial stress is applied to the specimen or sample 204 through hydraulically activated end caps 206*a*, 206*b* of a pressure vessel 202, or cell. A hydrostatic confining stress provided by an external pump 220 is monitored by a pressure gauge 208 that had an accuracy of 0.01 MPa (1.45 psig). The liquid metal alloy 210 pressure is applied to one side of the sample, creating a pressure gradient across the sample 204 that results in metal flow from the higher pressure to the lower pressure. The pressure gradient may be measured with the use of an upstream pressure gauge 212 and maintained using a pressure regulator 214. A reservoir 218 at the downstream side collects any excess metal alloy from the fracture. The experimental system is capable of measuring the quantity of liquid metal injected, and a rate of the liquid flow.

Figure 3:
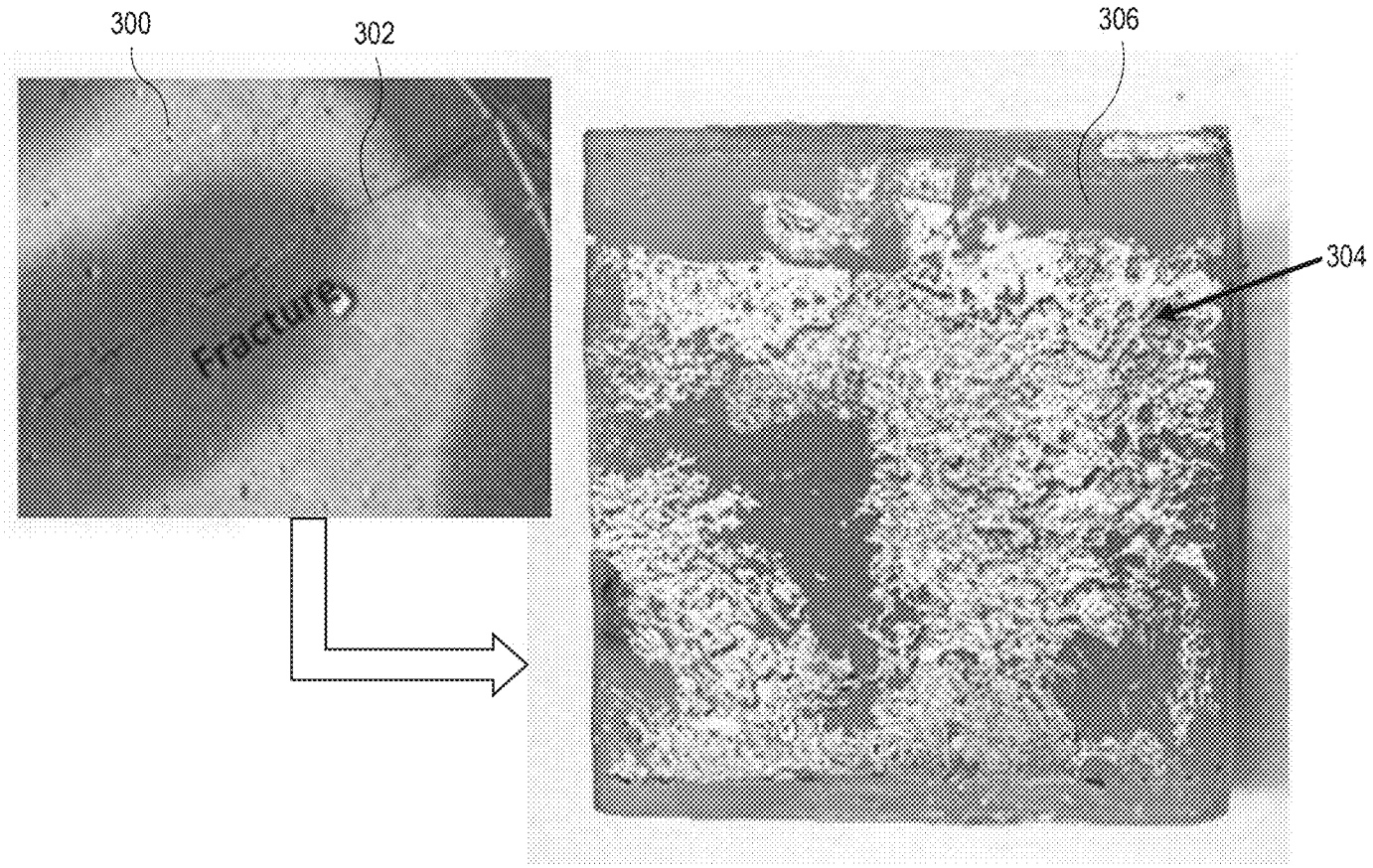
FIG. 3 is a series of photographs depicting a fracture and a cross section of the fracture having a liquid metal alloy therein, in accordance with the present disclosure.

FIG. 3 is a series of photographs depicting a fracture and a cross section of the fracture having a liquid metal alloy therein, in accordance with the present disclosure. As shown in FIG. 3 in a top view 300, the hydraulic aperture (aperture size) of the fracture 302 under confining stress was about 40 μm. The injected metal alloy 304 inside the fracture, as shown in cross-section 306, is then preserved by solidification at a lower temperature of about 16.2° C. (61.2° F.), followed by removal from the cross-section 306. The preserved injected metal can be used to calculate the total pore volume, surface area, pore size distribution.

Liquid metal alloys of the present disclosure are composed of gallium (Ga), indium (In), bismuth (Bi), and tin (Sn). The liquid metal alloy is liquid at room temperature of about 24° C. (75.2° F.) and turns to solid at a temperature below 16.2° C. (61.2° F.). The measured alloy density is 8.33 g/cm$^3$. Due to the high density and the rheological properties of the alloy at room temperature, it can be advantageous when used in a number of applications.

As mentioned herein, commercially available metal alloys present in the market suffer from the disadvantage that they contain certain toxic metals. The low toxicity of the metal alloy of the present disclosure provides a desirable material for medical and biological applications. For example, mercury intrusion porosimetry (MIP) is a method for evaluating sample properties such as pore size distributions, total pore surface area, total pore volume, and sample densities.

Despite the hazardousness and environmental concerns of the method due to the usage of mercury, to date, limited alternative liquid metal are available for this purpose. A non-wetting liquid metal as described herein can flow through micro-channels at critical pressure, potentially replacing toxic mercury, which is currently used in porosimetry. An exemplary porosimetry method may include melting a metal alloy comprising gallium, indium, bismuth, and tin to form a liquid metal alloy, introducing the liquid metal alloy into a test material, and observing the metal alloy entrained within the test material.

The ability to inject conductive liquid metal into micro-channels can be advantageous for the fabrication of low-cost, flexible electronic components such as flexible or microscale wires, circuit elements, electrodes, electromagnets, semi-conductor components, or self-repairing conductors for microchips. As the liquid metal alloy described herein is electrically conductive, with the resistivity of the alloy being low, this property allows liquid metal alloys of the present disclosure to be used as contact electrodes for the electrical characterization of thin-film organic and semiconductor devices, and the like. Additionally, the high-density, thermally conductive liquid metals can be advantageous for use as a possible coolant for fusion reactors. The inherent nonreactivity of the liquid metal alloy compositions provide a safer alternative as compared to other liquid metals, such as lithium and mercury. A liquid cooling method may include introducing a metal alloy as described herein into a system wherein the metal alloy contacts a heat source.

Based on the capability of metal alloys as described being flowable within and through micro-channels, it can be advantageous for use in casting many forms of mold or even porous media for obtaining a near-instantaneous high-resolution impression. The non-wetting properties of the metal alloy further provide an easily separable casting media finding applicability in scientific studies, forensic investigation, industrial use, and the like. An additional advantage includes the metal alloy leaving little or no residue in a sample. An investment casting method can include melting a metal alloy composed of gallium, indium, bismuth, and tin to form a liquid metal alloy, introducing the liquid metal alloy into a mold or specimen, and allowing or causing the liquid metal alloy to cool to form a solid to produce a pattern from the mold. The viscosity of liquid metal alloys as disclosed can be substantially low, or about 1.55×10-3 Pa·s, which provides a liquid metal able to flow readily into tight, or very small fractures, including those lower than 100 microns in size. The low viscosity can further enable liquid metal alloys as described herein to be used as an electrically conductive, thermally stable lubricants. Additional applications related to liquid metal alloys of the present disclosure include crack repair for industrial oil and gas applications, automotive repair, i.e. metal tire rims, and evaluation and structural repair of rock or other geographical sample fractures. Applications related to liquid metal alloys of the present disclosure can include structural repair of geographical samples, architectural structures, automotive applications, underground storage structures or containers, coolants for nuclear and other technologies, medical applications such as ultrasonic pulse measurement applications, dental applications such as filling, and the like. Liquid metal alloys as described herein may be reusable or remelted for repetitive use or re-use in other applications.

Figure 4:
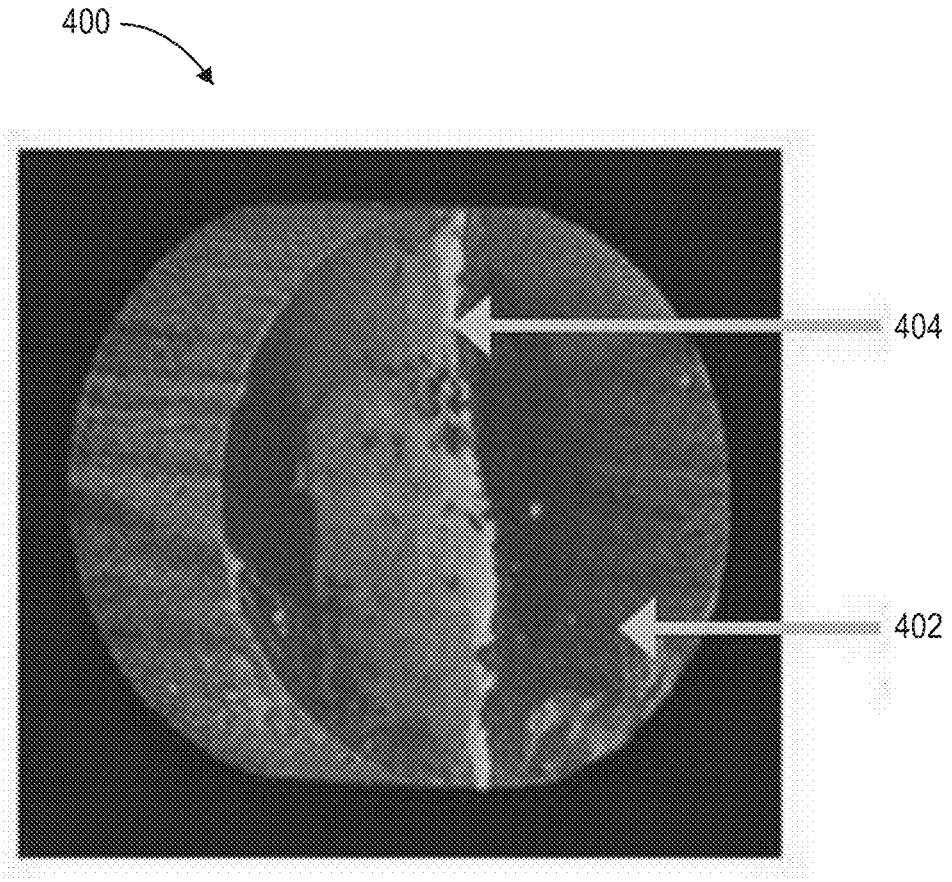
FIG. 4 depicts an induced extension fracture in a rock sample observed with a computerized tomography (CT) scan after an injection of a liquid metal alloy to quantify the rock damage, in accordance with the present disclosure.

FIG. 4 depicts an induced extension fracture in a rock sample observed with a computerized tomography (CT) scan after an injection of a liquid metal alloy to quantify the rock damage, in accordance with the present disclosure. An exemplary computerized tomography scan 400 of a rock 402 or geographical sample or specimen is tested according to methods and procedures of the present disclosure having a metal alloy 404 injected into a fracture. Due to its higher density, an injected metal alloy 404 present in a fractured or porous media can be clearly observed using a CT scan. The induced extension fracture in the rock 402 sample observed with a CT scan 400 after the injection of the novel metal alloy 404 provides a quantification of damage to the rock 402.

While the present teachings have been illustrated with respect to one or more implementations, alterations and/or modifications may be made to the illustrated examples without departing from the spirit and scope of the appended claims. For example, it may be appreciated that while the process is described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or embodiments of the present teachings. It may be appreciated that structural objects and/or processing stages may be added, or existing structural objects and/or processing stages may be removed or modified. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items may be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. The terms "couple," "coupled," "connect," "connection," "connected," "in connection with," and "connecting" refer to "in direct connection with" or "in connection with via one or more intermediate elements or members." Finally, the terms "exemplary" or "illustrative" indicate the description is used as an example, rather than implying that it is an ideal. Other embodiments of the present teachings may be apparent to those skilled in the art from consideration of the specification and practice of the disclosure herein. It is intended that the specification and examples be considered as exemplary only, with a true scope and spirit of the present teachings being indicated by the following claims.

What is claimed is:

1. A method of preparing a liquid metal alloy, comprising:

introducing gallium, indium, bismuth, and tin into a pressurized chamber;

introducing an inert gas into the pressurized chamber; and raising the pressurized chamber to an elevated temperature to melt and combine the gallium, indium, bismuth, and tin to form the metal alloy;

wherein the liquid metal alloy comprises no copper or thallium; and wherein the bismuth is present in an amount of about 15 wt % based on a total weight of the metal alloy; and wherein the metal alloy has a contact angle of from about 90 degrees to about 140 degrees.

2. The method of preparing a metal alloy of claim 1, wherein the inert gas is nitrogen.

3. The method of preparing the liquid metal alloy of claim 1, wherein the gallium is present in an amount of from about 60 wt % to about 70 wt % based on a total weight of the metal alloy.

4. The method of preparing the liquid metal alloy of claim 1, wherein the indium is present in an amount of about 30 wt % based on a total weight of the metal alloy.

5. The method of preparing the liquid metal alloy of claim 1, wherein the tin is present in an amount of from about 0.5 wt % to about 20 wt % based on a total weight of the metal alloy.

6. The method of preparing the liquid metal alloy of claim 1, wherein the metal alloy comprises no mercury.

* * * * *